United States Patent [19]

Klinger

[11] Patent Number: 4,641,710

[45] Date of Patent: Feb. 10, 1987

[54] ENHANCED RECOVERY OF SUBTERRANEAN DEPOSITS BY THERMAL STIMULATION

[75] Inventor: Barney Klinger, Santa Barbara, Calif.

[73] Assignee: Applied Energy, Inc., Vancouver, Canada

[21] Appl. No.: 829,694

[22] Filed: Feb. 13, 1986

Related U.S. Application Data

[63] Continuation-in-part of Ser. No. 657,683, Oct. 4, 1984, abandoned.

[51] Int. Cl.[4] ..... E21B 36/00; E21B 43/24

[52] U.S. Cl. ..... 166/303; 166/57; 166/266; 166/272

[58] Field of Search ..... 166/272, 303, 302, 57

[56] References Cited

U.S. PATENT DOCUMENTS

| | | | |
|---|---|---|---|
| 56,989 | 8/1866 | Phleger et al. | 166/303 X |
| 2,911,047 | 11/1959 | Henderson | 166/302 X |
| 2,980,184 | 4/1961 | Reed | 166/303 X |
| 3,237,689 | 3/1966 | Justheim | 166/302 X |
| 3,420,302 | 1/1969 | Edwards | 166/303 X |
| 3,493,050 | 2/1970 | Kelley et al. | 166/302 X |
| 3,994,340 | 11/1976 | Anderson et al. | 166/272 |
| 3,994,341 | 11/1976 | Anderson et al. | 166/272 |
| 4,037,658 | 7/1977 | Anderson | 166/272 |
| 4,083,404 | 4/1978 | Allen | 166/261 |
| 4,372,386 | 2/1983 | Rhoades | 166/300 |

*Primary Examiner*—Stephen J. Novosad

*Attorney, Agent, or Firm*—Benoit Law Corporation

[57] ABSTRACT

Methods and apparatus for enhanced recovery of subterranean deposits employ a heated fluid driven into the subterranean formation. A heating fluid is heated at the surface of the earth remote from the subterranean formation to a heated state providing a temperature sufficient for a conversion of a liquid to a vapor phase at the subterranean formation by a transfer of heat from the heating fluid to that liquid. The heating fluid is circulated in a closed circuit extending for the heating fluid at the heated state to the subterranean formation and then back to the earth surface for repeated reheating at that surface to the heated state and for circulation of the heating fluid at said heated state to the subterranean formation. A separate liquid is stored at the surficial formation and is advanced to the subterranean formation in the hole, where it is heated or vaporized by the heating fluid in the wellbore for release of the subterranean deposits, while that heating fluid is preserved against combustion and chemical reaction during heating, circulation, reheating and recirculation thereof and during application of heat to, and conversion to a vapor phase of, any liquid, and the heating fluid is also preserved against escape into the subterranean formation.

35 Claims, 2 Drawing Figures

ENHANCED RECOVERY OF SUBTERRANEAN DEPOSITS BY THERMAL STIMULATION

CROSS-REFERENCE

THis is a continuation-in-part of my earlier patent application Ser. No. 06/657,683, filed Oct. 4, 1984, now abandoned.

BACKGROUND OF THE INVENTION

1. Field of the Invention

The present invention relates to the release or recovery of subterranean deposits and, more specifically, to system for enhanced recovery of petroleum or other subterranean deposits by injection of steam or heated fluid into subterranean formations.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material, which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

Particularly the recent history of steam injection for enhanced recovery of petroleum or oil deposits furnishes an eloquent example of the extremes to which man will go in his quest for the optimum solution, when confronted with a generally perceived insurmountable impasse in a potentially promising and highly rewarding path of progress.

In this respect, there are in the United States and elsewhere in the world a large number of huge petroleum or oil deposits (hereinafter generically referred to as "oil" or "oil deposit") which cannot be released without intensive thermal stimulation thereof. Various types of thermal stimulation, the perceived objective of which is to raise the temperature of the oil formation to lower the oil viscosity, and enhance oil flow, have heretofore been proposed. These include electric or hot water heaters, gas burners, in situ combustion, hot water or steam injection, and employment of miscible phase displacement fluid, such as carbon dioxide. Of these approaches, the steam injection system appears to be the most promising, though currently beset by various limitations and problems.

Straightforward steam injection systems generate steam above ground and pipe it down the borehole toward the subterranean formation. In practice, the feasibility of such conventional systems ends at relatively low depths, since the steam rapidly loses heat and quality as it travels down the borehole. Even the insulation of steam delivery pipes entails practical depth and cost limitations.

Affordability of such conventional methods is also impaired by the high feedwater quality required of such systems, if higher efficiency is desired. Since feedwater of required purity is seldom available at drilling sites, feedwater treatment is an important part of steam generation. Accordingly, the cost of feedwater, either from a pure source or after suitable treatment, is high to the extent of being unaffordable in most cases.

In consequence, conventional systems frequently employ part of the unboiled water in conjunction with the generated steam as a flushing agent for preventing clogging and similar drawbacks of untreated or poorly treated feedwater. Steam qualities of 80%, with 20% of the piped compound being water, are thus rather frequent. In practice this, of course, still worsens the situation, since the water component does not have the latent heat possessed by steam for the desired recovery enhancement.

Failing further progress in the originally promising direction, in situ generation of steam in the borehole has been tried, particularly in the hope of substantially increasing thereby feasible borehole depths of enhancement.

In terms of historical perspective, such proposals may be viewed in a sense as attempts to miniaturize and to displace a surface boiler way down into the borehole. In practice, that approach, however, has raised serious problems of fuel, combustion air or oxygen supply to, and combustion product removal from, the requisite large depths. Since pumping air at high pressures and over long distances requires equipment of immense size and operating energy, it has been proposed to pipe liquid oxygen, so as to avoid at least the pumping of the useless nitrogen component in natural air. However, this has just further increased equipment and operating costs.

In this respect, even systems which avoid use of high-pressure air compressors, frequently produce unacceptable environmental pollution due to the venting of gases spent in the downhole steam generator.

Thermochemical energy transport systems attempt to avoid problems of the latter type by employing a reversible, catalytically-controlled reaction, particularly the $CO_2$—$CH_4$ reforming methanation chemical cycle, as already known from the solar energy exploitation field.

In one of these systems, an open cycle is employed in which the carbon dioxide and methane developed in the methanation reaction in the downhole catalytic converter/ heat exchanger are not recycled to the reservoir, as in the other system, but are instead discharged into the subterranean formation along with the steam generated in the heat exchanger. This, of course, results in a continuous loss of the carbon monoxide and hydrogen working fluid, and also raises an environmental question as to the effect of the methanation reaction products on the subterranean formation and deposits into which they are discharged.

In either case, whether the methanation reaction or combustion product is recycled or discharged, the heat exchanger in which the steam is formed is followed by the steam expansion chamber which is usual in such downhole systems, before the steam is applied to the subterranean formation.

To date, such reversible, catalytically-controlled reactions have been proposed for the solar energy field and are believed to require considerable research and experience for use in subterranean deposit recovery.

Other methods tried so far include miscible slug and gas processes in which liquid hydrocarbons or gases are injected into the subterranean deposit. In micellar solution flooding, surfactants, colloids or electrolytes are injected, while polymer flooding injects polysaccharide, polyacrylamides or other polymers.

In practice, such methods and their materials are very expensive and of doubtful value, as presently conceived.

Against this state of the art, a peculiar type of in situ combustion which has all the trappings of an act of desparation, appears almost as a relatively attractive solution to the prior-art worker. In particular, that kind of thermal recovery essentially consists of setting the oil reservoir on fire with the aid of injected air or oxygen. The fire in the well and undergound reservoir causes the lighter fractions of oil ahead of the flame to vaporize, leaving a heavy residual coke or carbon deposit as fuel for the reservoir burning process. Vaporized light components and steam formed by combustion are carried forward through the deposit until they condense upon contacting cooler portions of the reservoir. Accordingly, the term forward combustion is often applied to this kind of in situ process to signify that the flame front is advancing the the same direction as the air movement, that is, from the injection well to the producing well.

There also is a reverse combustion in which the ignition is started in the well that is supposed to be the producer. For that kind of process to work at all, the reservoir need to have high air permeability. As in fires on the surface of the earth, simultaneous or alternate injection of water into the conflagration is often indicated.

Disadvantages of such a draconic approach are exposure of the well and the producing equipment to severe damage by heat and corrosion, contamination of the oil and the subterranean formation, and an inherently inefficient operation.

Even worse in this respect is the proposal of Clarence I. Justheim, who in his U.S. Pat. No. 3,237,689, issued Mar. 1, 1966 suggested use of a nuclear reactor for distillation of underground deposits of solid carbonaceous materials in situ. Justheim in particular suggested heat transfer from the nuclear reactor to a circulating molten metal, such as liquid sodium, which, in turn, would transfer heat to a secondary heat-transfer medium via an intermediate heat exchanger. Secondary heat-transfer media mentioned by Justheim include a liquid or a gas or a combination of both, such as water, air, or superheated steam. Obviously, Justheim added the inherent dangers of a nuclear reaction and liquid sodium cycle to the above mentioned inherent dangers and disadvantages of conventional systems.

An oil recovery process utilizing air and superheated steam is disclosed in U.S. Pat. No. 4,083,404, by Joseph C. Allen, issued Apr. 11, 1978. Allen proposed turning the injection well into a superheater by the use of a steam generator, a steam boiler, and an air compressor, injecting superheated steam and air under pressure into the formation whereby in situ combustion is initiated for driving petroleum in the formation toward a production well. This proposal appears to partake of the above mentioned disadvantages of conventional steam generation and pressurized air injection.

SUMMARY OF THE INVENTION

It is a general object of this invention to overcome the disadvantages and to meet the needs expressed or implicit in the above Information Disclosure Statement or in other parts hereof.

It is a germane object of this invention to provide improved systems for the release or recovery of subterranean deposits.

It is a related object of this invention to provide improved systems for an enhanced recovery of petroleum or other subterranean deposits by injection of steam or at least of a heated fluid into subterranean formations.

It is a further object of this invention to provide improved products of enhanced recovery methods or processes, that are superior to the products of prior-art methods.

Other objects of this invention will become apparent in the course of this disclosure, and no limitation to any object or group of objects is intended by this brief summary.

From a first aspect thereof, the subject invention resides in a method of removing deposits releasable by a substance in a vapor phase from a subterranean formation below a surficial formation. The method according to this aspect of the invention comprises, in combination, the steps of providing a hole through the surficial formation to the subterranean formation, storing said substance at the surficial formation in the form of a liquid convertible at the subterranean formation to said vapor phase, providing a heating fluid heatable at a surface of the surficial formation remote from the subterranean formation to a temperature sufficient for a conversion of the liquid to the vapor phase at the subterranean formation by a transfer of heat from the heating fluid to said liquid, heating the heating fluid at the surface of the surficial formation remote from the subterranean formation to a heated state providing said sufficient temperature and circulating said heating fluid in said hole in a closed circuit extending for the heating fluid at the heated state to the subterranean formation and then back to said surface for repeated reheating at that surface to said heated state providing said sufficient temperature and for recirculation of the heating fluid at said heated state to the subterranean formation, advancing the convertible liquid to the subterranean formation at said hole, applying heat from the recirculating heating fluid in said hole to said liquid, converting said liquid into a vapor by said application of heat from the recirculating heating fluid in said hole, but preserving the heating fluid against combustion and chemical reaction during heating, circulation, reheating and recirculation thereof and during application of heat to, and conversion to a vapor phase of, said liquid, and preserving the heating fluid against escape into the subterranean formation, driving the vapor into the subterranean formation for releasing deposits with that vapor, and removing such released deposits from the subterranean formation.

From a related aspect thereof, the subject invention resides in apparatus for enhanced recovery of deposits releasable by a substance in a vapor phase from a subterranean formation below a surficial formation via a hole through that surficial formation to the subterranean formation. The invention according to this aspect resides, more specifically, in the improvement comprising, in combination, means at the surficial formation for employing said substance in the form of a liquid convertible at the subterranean formation to said vapor phase, means for heating a heating fluid at a surface of the surficial formation remote from the subterranean formation to a heated state providing a temperature sufficient for a conversion of said liquid to the vapor phase at the subterranean formation by a transfer of heat from the heating fluid to said liquid, means connected to the heating means for circulating the heating fluid in said hole in a closed circuit extending for that heating fluid at said heated state to the subterranean formation and then back to the surface for repeated reheating at that surface by the heating means to said heated state providing said sufficient temperature and for recirculation of the heating fluid at said heated state to the subterranean formation, means connected to the storing means for advancing the convertible liquid to the subterranean formation at said hole, means for applying heat from the recirculating heating fluid in said hole to said liquid and for converting said liquid into a vapor by said application of heat from the recirculating heating fluid in the hole, and means for driving the vapor into the subterranean formation for releasing deposits from the subterranean formation. According to the invention, the heating means, circulating means and the means for applying heat from the recirculating heating fluid to said liquid including means for preserving the heating fluid against combustion and chemical reaction during heating, circulation, reheating and recirculation thereof and during the application of heat to, and conversion to the vapor phase of, said liquid, and for preserving the heating fluid against escape into the subterranean formation.

Other aspects of the invention will become apparent in the course of this disclosure, and no restriction to any aspect, combination or feature is intended by this brief summary.

BRIEF DESCRIPTION OF THE DRAWINGS

The subject invention and its various aspects and objects will become more readily apparent from the following detailed description of preferred embodiments thereof, illustrated by way of example in the accompanying drawings in which like reference numerals designate like or functionally equivalent parts, and in which.

DESCRIPTION OF PREFERRED EMBODIMENTS

Figure 1:
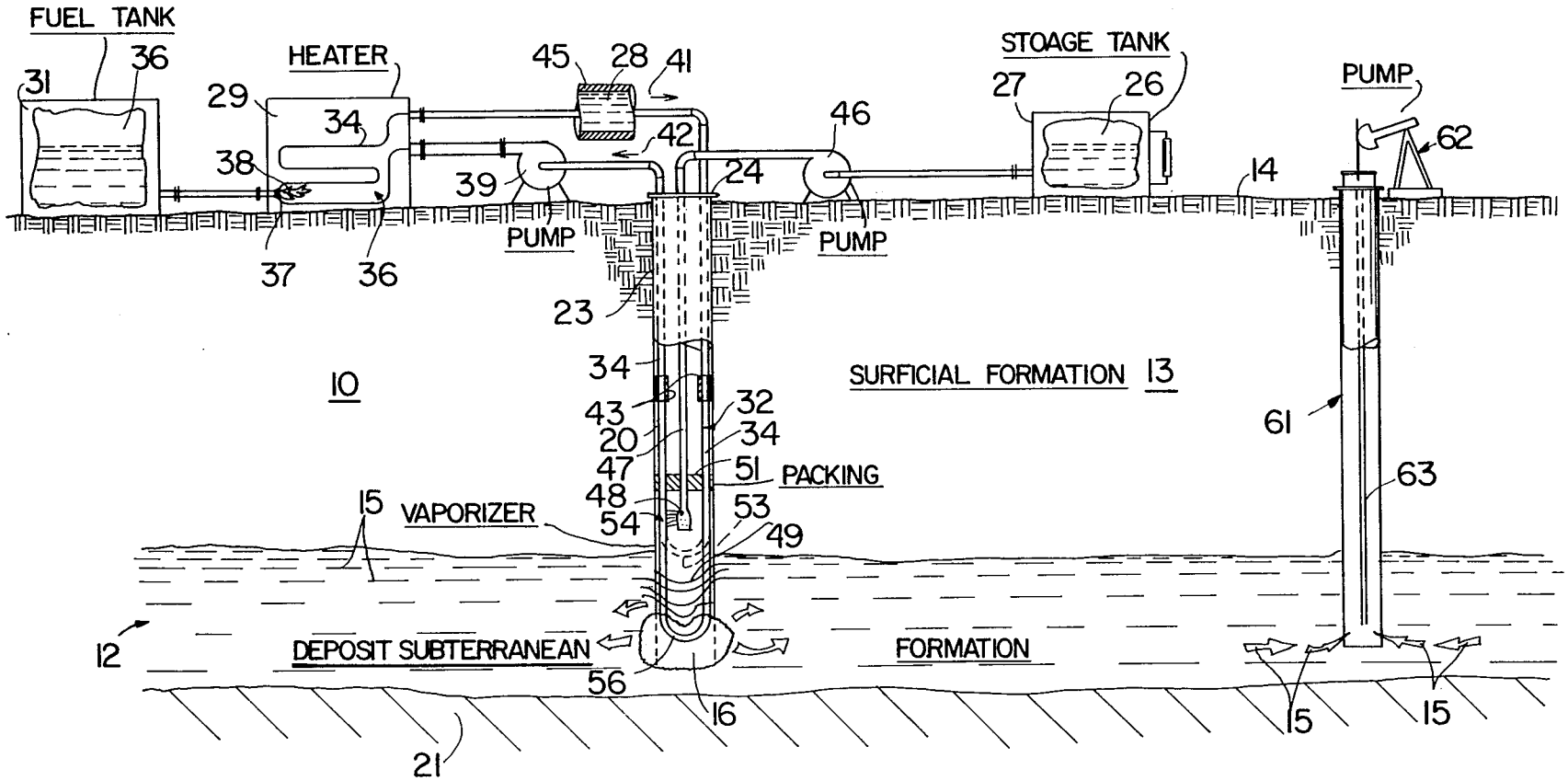
FIG. 1 is a diagrammatic showing, in a section of an earth formation, of a system for removing geological deposits from a subterranean formation by enhanced recovery according to an embodiment of the invention.

The earth formation 10 shown in FIGS. 1 and 2 includes a subterranean formation 12 below a surficial formation 13 topped by a surface 14 which typically is the surface of the earth. The subterranean formation 12 includes deposits 15 which are removable or releasable therefrom, such as by means of a substance in a vapor phase 16 or another heated fluid substance 17 in what may be termed a secondary, tertiary or other enhanced recovery process.

A typically vertical hole 20 is provided from the surface 14 through the surficial formation 13 to the subterranean formation 12. Conventional well bore equipment may be used for that purpose. In fact, the hole 20 in many cases will be a borehole of a well which is no longer economically exploitable by pumping or other conventional methods. Among the generally well-known reasons for such a depletion are a viscosity of the remaining oil deposit that has become too high for removal by pumping or, in the case of secondary recovery, for exploitation with the aid of waterflooding. Also, a well may become uneconomical to operate if the formation adjacent its borehole is plugged or clogged by waxes, paraffins and other impediments. Moreover, there are huge reservoirs of subterranean deposits which have never been subject to exploitation, be it in view of a very high viscosity to start with or because of other factors resisting conventional exploitation.

The present invention provides novel combinations of method steps and apparatus components overcoming the latter disadvantages and providing enhanced recovery systems that open up huge dormant oil reserves of the earth to economically feasible exploitation which is more attractive in its product than comparable prior-art methods and proposals.

The subterranean formation 12 may rest on bedrock 21 and the deposit to be recovered may be located thereon. However, while the system shown in FIG. 1 is particularly suitable for recovering deposits which are too far down for conventional or even for prior-art enhanced recovery, the systems shown in FIGS. 1 and 2 are also suitable for substantially improved enhanced recovery at lesser depth.

Typically, the vertical hole 20 is equipped with a tubular casing 23, only the upper portion of which below the well head 24 is shown in the drawings.

Within the scope of the subject invention, the substance employed for releasing the deposit 15 may be in the form of a liquid 26 convertible at the subterranean formation 12 to a vapor phase, such as the vapor phase 16 indicated in FIG. 1. As also shown in FIG. 1, the liquid 26 may be stored in a tank 27 at the earth surface 14 or surficial formation 13.

The subject invention also provides a heating fluid 28 heatable at a surface of the surficial formation 13 remote from the subterranean formation 12 to a temperature sufficient for a conversion of the liquid 26 to its vapor phase at the subterranean formation 12 by a transfer of heat from such heating fluid 28 to the liquid 26.

According to the illustrated embodiment, a heater 29 is employed for heating the heating fluid 28 at a surface of the surficial formation 13 remote from the subterranean formation 12 to a heated state providing the above mentioned temperature sufficient for a conversion of the liquid 26 to its desired vapor phase. In practice, the heater 29 preferably is a low-pressure heater, as distinguished from a high-pressure boiler. Since according to the subject invention the heating fluid 28 is not converted to a vapor that is injected into the subterranean formation, it is a particular advantage of the subject invention that no high-pressure boiler need be employed at 29. The subject invention thus effectively obviates a prior-art systems component which either was very bulky and expensive in order to be reasonably safe or which posed a constant threat of destruction and injury through explosion.

Moreover, since the subject invention does not contemplate subjection of the heating fluid to subterranean combustion or chemical reaction, no methane reformation equipment or other endothermic reactor need be employed at 29. Rather, a heater operating below 300 psig or at an even lower pressure may be employed.

The heater 29 is shown at the surface 14 of the earth, where it is usually located in practice. However, within the scope of the subject invention, the heater 29 and even the storage tank 27 and fuel tank 31 may be located underground at the surface 14, such as in a depressed silo or other laterally enclosed space.

It is to be well understood, however, that the subject invention does not contemplate provision of any directfired downhole steam generator at or near the location where the liquid 26 is converted to its vapor phase. Rather, the subject invention avoids the above mentioned and other drawbacks of directfired downhole steam generation by providing and operating the heater 29 above the surface 14 as shown in the drawings or, at best, in the surficial formation 13 at the surface 14, but always remote from the subterranean formation 12.

The subject invention circulates the heating fluid 28 in its heated state in the hole 20 in a closed circuit 32 extending for such heating fluid at its heated state to the subterranean formation 12 and then back to the surface 14 for repeated reheating at that surface to its heated state providing the above mentioned sufficient temperature and for recirculation of that heating fluid 28 at its heated state to the subterranean formation 12, and so forth continuously or continually through the closed circuit 32.

In the illustrated embodiments, the circulating system for the heating fluid 28 include a string of conduits 34 interconnected in a closed loop or circuit 34. Part of the interconnected conduits 34 even extend into the heater 29 where they form the heater coils 36 through which the heating fluid 29 extends.

Drawing heating oil or another fuel 36 from the fuel tank 31, a burner 37 provides one or more flames for heating the coils 34 and the heating fluid 28 circulating therethrough.

A pump 39 may be employed for sustaining the circulation of the heating fluid 28 through the heater 29 and the remainder of the closed loop 32 in the desired direction, such as the direction of circulation indicated by arrows 41 and 42. If desired or necessary, heat losses may be reduced by providing part of the pipes 34 with thermal insulation 43. While not shown thereon, such heat insulation may also extend over the upper part of the conduits 34, a portion 45 of which has been shown on an enlarged scale in order to illustrate the heating fluid 28.

According to FIG. 1, liquid 26 is advanced by a pump 46 from the storage tank 27 through a conduit 47 down the vertical hole 20 to the area of the subterranean formation 12. With the aid of a heat exchanger or vaporizer 48, heat from the recirculating heating fluid 28 is in the hole 20 applied to the liquid 26 for converting that liquid into a vapor 49 by application or exchange of heat from the recirculating heating fluid 28 in the hole 20. Various types of downhole heat exchangers may be employed at 48, but it is to be kept well in mind that no downhole combustion takes place at the site of steam generation in the system of the subject invention.

FIG. 1 shows the vaporizer 48 as an irrigator which sprinkles the downwardly flowing liquid 26 against pipe 34 heated sufficiently by the circulating heating fluid 28 for a conversion of the separate liquid 26 into a vapor 49 by application of heat from the recirculating heating fluid 28 in the hole 20. In the illustrated preferred embodiment, a reverse flow principle is employed, in that the liquid 26 is vaporized only at the portion of the pipe 34 in the return flow of heating fluid 28 in the closed loop 32. In this manner, the heat energy of the fluid 28 is preserved for superheating the vapor 49 downhole of the vaporizer 48.

According to the subject invention, the circulating heating fluid 28 is preserved against combustion and chemical reaction during heating, circulation, reheating and recirculation thereof and during the application of heat to, and conversion to the vapor phase of, the liquid 26, and the heating fluid 28 is also preserved against escape into the subterranean formation 12. In the illustrated embodiments, the means so preserving the heating fluid 28 against combustion, chemical reaction and escape to the subterranean formation include the pipes 34 which are interconnected tightly into the closed circuit 32 from which no heating fluid can escape to the earth. Of course, as in most practical systems, occasional recuperation or replenishment of the circulating heating fluid 28 may be desirable or necessary. However, for all practical intents and purposes, the heating fluid 28 is not subjected to combustion, chemical reaction or application to the subterranean formation 12.

In this manner, the above mentioned and other drawbacks of prior-art systems which employed combustion or chemical reaction of the working fluid or which drove such fluid or its combustion products into the earth formation are safely avoided. Whatever combustion there is, is preferably limited to the fueling of the heater 29, where it can be handled from an environmental point of view much better than down in the wellbore 20. Also, the heating fluid 28 is constantly recycled and thereby economically preserved and is kept from injecting itself or escaping into the subterranean formation 12. In this manner, a heating fluid which is best for the heating or vaporization of the working fluid 26 can be employed, without regard to its possible impact on the subterranean formation 12 or the deposits 15.

The vapor 49 produced from the liquid 26 is driven or injected into the subterranean formation 12 releasing the deposits 15 with such vapor injected into the subterranean formation.

A packing 51 is employed for closing the wellbore 20 or casing 23 against an upward escape of vapor. The vapor 49 is thus driven or injected into the subterranean formation 12 for a release of the deposits 15 therein or therefrom. Within the scope of the subject invention, the closed loop 32 or piping 34 may have a U-turn 53 at the region 54 where the vaporization of the liquid 26 takes place.

However, according to the most effective embodiment of the subject invention, the circulation of the heated heating fluid 28 is extended into the subterranean formation 12 downwardly of the region 54 of conversion of the liquid 26 into the vapor 49, for heating such vapor after that conversion.

As shown in FIG. 1, the extension of the heating fluid circulation may be effected by a downward extension 56 of the closed loop 32 or sealed piping 34 in the lower portion of the wellbore 20 extending into the subterranean formation 12. In practice, the extension 56 may, for instance, constitute an extended U-turn of the closed recirculation loop or piping.

Heat from the heating fluid 28 in the extended circulation 56 is applied to the vapor 49 of the liquid 26, while such recirculating heating fluid 28 is heated sufficiently at 29 to effect heating of the vapor 49 in the subterranean formation 12 with that heating fluid in its extended circulation, before heat is withdrawn from the heating fluid by the vaporization at 54.

In this manner, the quality of the vapor 49 is greatly improved according to a preferred aspect of the subject invention. "Vapor quality," like "steam quality," refers to the percentage of the vapor or steam in the vaporized product driven into the subterranean formation. By way of example, 80% vapor quality would refer to a injected product of vaporization in which 80% is vapor 49 while the remaining 20% is unevaporated saturated liquid 26. Since it is the vapor 49, rather than the liquid 26, that contains the latent heat which is most effective in a release of the subterranean deposit 15, it stands to reason that the recovery process is greatly benefited by as high a vapor quality as possible.

However, there are inherent practical limitations to vapor quality in prior-art systems. For instance, prior-art steam generators that work at safe pressures are typically producing wet steam of only 70% to 80% quality. In fact, such a limited quality is directly encouraged in conventional systems which try to concentrate dissolved solids of available fresh water in the unevaporated component of wet steam to prevent clogging of their steam downhole conduits or convoluted vaporizers.

Contrary to such deliberate prior-art limitation, the preferred embodiment of the subject invention keeps heating the vapor 49 to a quality preferably in excess of 80% before it is injected into the subterranean formation through perforations (not shown) in the well casing 23 at the subterranean formation 12.

Scale forming on the pipe 34 at 54 may be sloughed off from time to time by alternating contraction and expansion of the pipe, such as by periodically switching the evaporation process or reversing the direction of flow of the heating fluid 28. Rather impure water can thus be tolerated by the processes of the subject invention.

According to the presently most preferred embodiment of the subject invention, heat from the heating fluid 28 in the extended circulation 56 is applied to vapor 49 of the liquid 26, while such recirculating heating fluid is heated sufficiently at 29 for superheating the vapor 49 in the extended circulation 56 downhole of the vaporization region 54. The vapor 49 is thus converted into superheated vapor 16 which is driven into the subterranean formation 12 for an optimal release of the deposits 15. Under the above definition of vapor quality, a 100% quality indicates dry steam or vapor. The quality, therefore, cannot exceed 100%, since further heating of dry steam will cause the temperature to rise above the saturation temperature, whereupon the vapor 49 is said to be superheated. The amount of such temperature rise is indicated as the number of degrees of superheat. These physical properties are well known as such, but it is to be noted that the illustrated preferred embodiment of the subject invention resides in an enhanced recovery of subterranean deposits with superheated vapor or steam.

According to an embodiment of the subject invention, the liquid 26 may be water. In other words, the substance with which deposits 15 are releasable in a vapor phase may be employed in the form of water 26 convertible at the subterranean formation 12 to steam 49. It should be well understood in this respect that it is not the liquid or water 26 that carries the heat down the borehole 20, as is the case in prior-art processes in which steam is generated at the surface 14 and is piped to the subterranean formation, typically with entrained unevaporated water.

Rather, the thermal energy for converting the liquid or water 26 into steam 49 is imparted to, and contained in, the circulating heating fluid 28.

Accordingly, heat from the recirculating heating fluid 28 is applied in the hole 20 to the water 26 at the vaporizer 48 in the region 54, in order to convert that water 26 into steam 49, which is driven into the subterranean formation 12 for releasing the deposits 15 therewith.

Circulation of the heated heating fluid 28 may again be extended into the subterranean formation downwardly of a region 54 of conversion of the water 26 into steam 49, as shown at 56 in FIG. 1. Heat from the heating fluid 28 is applied in the extended circulation 56 to the steam 49, while there is reheating of the circulating heating fluid 28 sufficiently to effect conversion of that steam 49 into superheated steam 16. Such superheated steam is again driven into the subterranean formation 12 for releasing deposits 15 therewith.

Within the scope of the subject invention, and as appropriate to different subterranean and deposit formations, liquids 26 other than water may be employed in practising the invention. By way of example, the substance with which deposits 15 are releasable in a vapor phase may be employed in the form of oil convertible at the subterranean formation 12 to oil vapor. The liquid 26 thus may, for example, comprise diesel oil or gas oil pumped along line 47 to the vaporizer 48.

Heat from the recirculating heating fluid 28 is applied in the hole 20 to the oil issuing from the vaporizer 48, to convert such oil into its oil vapor 49 which is driven into the subterranean formation 12, if desired or necessary in the form of vapor 16 superheated at 56, in order to release subterranean deposits 15.

Unlike prior-art processes which use oil or gas as a fuel or heat generator as well, the subject invention and its equipment preserve both the heating fluid 28 and the oil vapor 49 against combustion during application of heat to the oil in the region 54.

In fact, the oil evaporated at 57 may be recovered from the subterranean formation 12 after condensation of the oil vapor 49 and may then be recirculated through storage tank 27, pump 46, pipe 47, vaporizer 48, and so forth. The same principle applies if water or any other substance is employed at 26. In other words, such substance 26 may be recovered from the subterranean formation 12 after condensation of its vapor to a liquid. In practice, such recovery of the substance for liquid 26 may take place in the course of removal of the released deposits 15 from the subterranean formation 12, or in the course of refinement of removed deposits.

According to a presently preferred embodiment of the subject invention, salt heated to a liquid state is used as heating fluid 28 for conversion of the liquid 26 to the vapor phase 49 or superheated vapor 16 by heat exchange at the subterranean formation 12. Such salt 28 is recirculated in its liquid state in the closed circuit 32, and such recirculating salt 28 is continuously reheated at the surface 14, such as in the heater 29 through which the closed loop including the pipes 34 and heating coils 36 extends.

By way of example, sodium chloride or calcium chloride may be employed as the circulating salt 28. Sodium itself is another possibility, and there are heat transfer salts which are especially manufactured and sold for heat transporting purposes and which may thus be advantageously used as the circulating heating fluid or liquid 28.

Another substance suitable as the heating fluid 28 is oil which in the past has been used for heat transfer purposes, such as in radiator systems of diesel engines. It is to be well understood, however, that the subject invention preserves the heating fluid 28 against combustion, whether such heating fluid is oil or any other heat transfer substance. This distinguishes the subject invention from prior-art enhanced recovery processes where oil, gas oil or gas is combusted at the downhole site for the production of steam or for any other thermal stimulation of the deposits 15 in the subterranean formation 12. Neither such a combustion nor any deliberate escape of the heating fluid 28 into the subterranean formation 12 contemplated by the subject invention.

Within the scope of the subject invention water may be used as the circulating heating fluid 28. Such water 28 is then circulated and recirculated in the closed circuit 32 and is heated and reheated in the heater 29 at the surface 14 sufficiently for a conversion of the other liquid 26 to the vapor phase 49 by heat exchange at the subterranean formation 12. The other liquid 26 is thus converted into its vapor 49 by application of heat from the heated recirculating water 28 to the other liquid 26 in the borehole 20.

Within the scope of the subject invention, it is important that the water used at 28 is not confused with the other liquid or water 26. In fact, the heated recirculating water 28 is preserved against escape into the subterranean formation 12, while the vapor 49 or superheated steam 16 of the other liquid or water 26 is driven into the subterranean formation 12 in order to release deposits 15 therein.

In order to preserve the low pressure of the heater 29, boiling of the water 28 is prevented during its heating and reheating at the surface 14 and during its circulation and recirculation in the closed loop 32 and during the application of its heat to the other liquid 26 in the hole 20. This further distinguishes the subject invention from the prior art which uses a steam generating high-pressure boiler instead of the low-pressure heater 29.

However, if water or a similarly volatile liquid is employed as the circulating heating fluid 28, then a certain pressure is preferably maintained in the closed circuit 34, such as to provide for a sufficient heat transfer for vaporization of the other liquid 26, while preventing boiling of the heating liquid 28. Accordingly, water may be used as the vaporizing liquid 26, as well as the heating fluid 28, as long as vaporization of that heating fluid 28 is avoided, such as by a higher pressure for the circulating water 28, than for the other liquid or water 26.

In principle, released deposits 15 may be removed from the subterranean formation, such as by pumping, through the same wellbore 20 in which the liquid 26 is vaporized.

In fact, what is known in the oil exploration industry as "huff and puff" operation may be employed for releasing deposits by vapor injection and removing such released deposits by pumping or the like in different cycles.

However, a more sweeping coverage of the subterranean formation 12 and its deposits 15 is generally obtained with one or more further wells 61 spaced and separate from, but proximate to the borehole 20. In line with oilfield terminology, such further wells 61 may be called producers, since, thanks to the operation of the subject invention, they are producing oil wells, rather than being depleted or unworkable because of such factors as excessive viscosity or too fine distribution of the deposits 15 in the subterranean formation 12.

A type of pump 62 familiar in oilfield exploration may be employed for removing the released deposits 15 through a pipe 63 from the subterranean formation 12.

Figure 2:
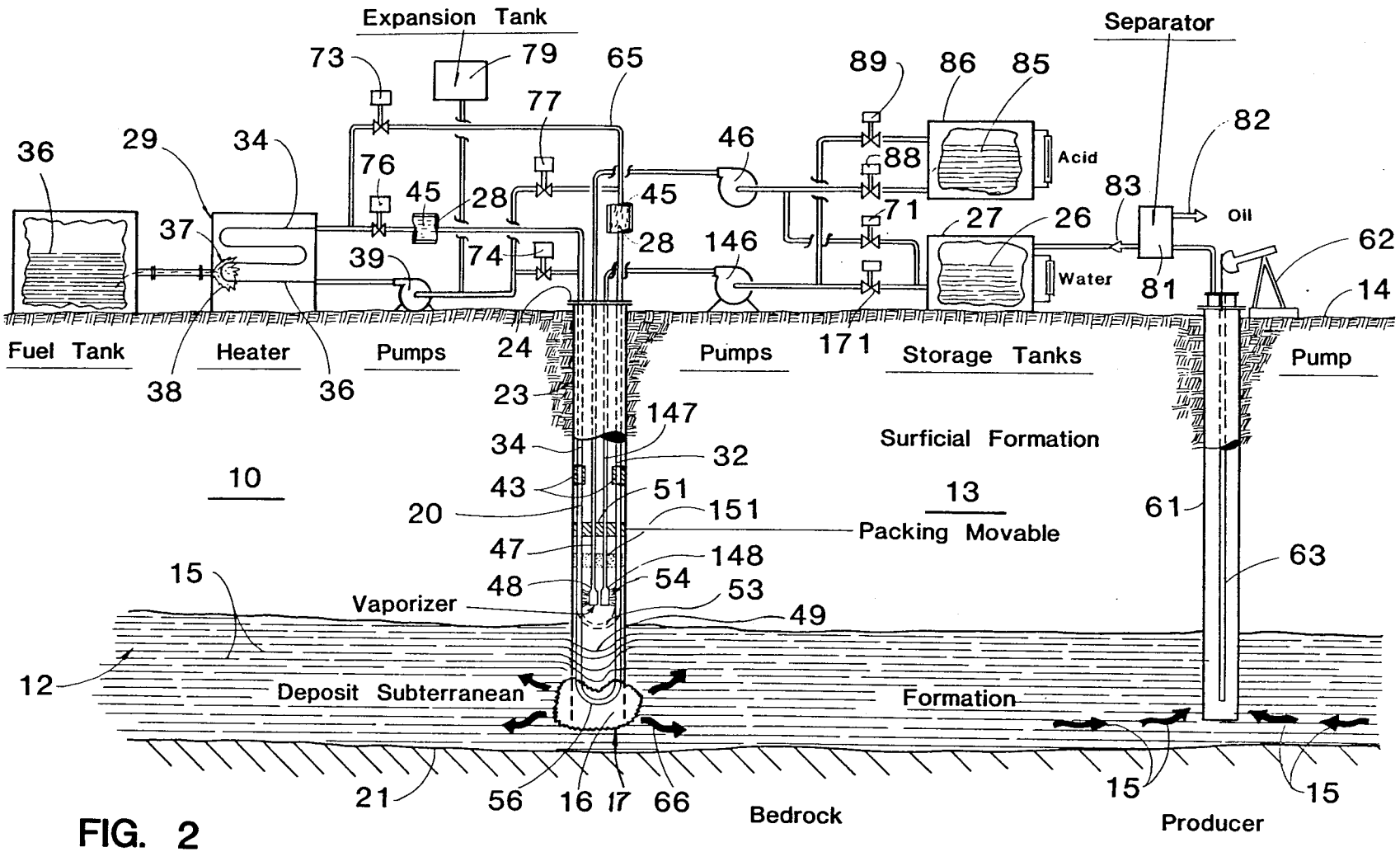
FIG. 2 is a diagrammatic showing, in a section of an earth formation, of a system for removing geological deposits from a subterranean formation by enhanced recovery according to further embodiments of the invention.

FIG. 2 illustrates use of equipment according to the subject invention in a further enhanced recovery method and system.

In particular, FIG. 2 shows apparatus 65 for enhanced recovery of deposits releasable by a heated fluid substance 17 from a subterranean formation 12 below a surficial formation 13 via a hole 20 through the surficial formation to the subterranean formation. The system shown in FIG. 2 includes a heater 29 for heating a heating fluid 28 at a surface 14 of the surficial formation 13 remote from the subterranean formation 12 to a heated state providing a temperature sufficient for heating that substance 17 by a transfer of heat from that heating fluid 28 to the substance 17 to a fluid substance 66 for a release of deposits 15 in the subterranean formation.

Piping 34 is connected to the heater 29 for circulating the heating fluid in the hole 20 in a closed circuit 32 extending for that heating fluid 28 at its heated state to the subterranean formation and then back to the surface 14 for repeated reheating at that surface by the heater 29 to its heated state providing the mentioned sufficient temperature and for recirculation of the heating fluid at that heated state to the subterranean formation 12. Heat from the recirculating heating fluid 28 in the hole 20 is applied to the substance 17 for heating that substance to its mentioned sufficient temperature, such as by a closed loop extension 56, and the substance 17 is driven as a heated fluid substance 66 into the subterranean formation 12 for releasing the deposits 15 with that heated fluid substance 66 for a removal of such released deposits from said subterranean formation, such as illustrated at the producer well 61.

As in FIG. 1 and in accordance with principles of the subject invention, the heater 29, circulating piping 34 and closed loop extension 56 for applying heat from the recirculating heating fluid 28 to the substance 17 are tightly sealed and otherwise include means for preserving the heating fluid 28 against combustion and chemical reaction during its heating, circulation, reheating and recirculation and during application of heat to that substance 17, and for preserving the heating fluid 28 against escape into the subterranean formation 12.

As far as advantages of the heating fluid circulation in a closed loop 32 and materials usable as the heating fluid 28 are concerned, reference may be had to the above description of the corresponding part of FIG. 1.

In method terms, the enhanced recovery system shown in FIG. 2 again provides a hole 20 through the surficial formation 13 to the subterranean formation 12, and providing a heating fluid 28 heatable at a surface 14 of the surficial formation 13 remote from the subterranean formation 12 by a transfer of heat from that heating fluid 28 to the substance 17 to a temperature sufficient for heating the substance 17 for a release of deposits 15 in the subterranean formation 12.

The method illustrated in FIG. 2 further includes the steps of heating the heating fluid 28 at the surface 14 of the surficial formation 13 remote from the subterranean formation 12 to a heated state providing the mentioned sufficient temperature and circulating that heating fluid 28 in the hole 20 in a closed circuit 32 extending for the heating fluid 28 at its heated state to the subterranean formation 12 and then back to the surface 14 for repeated reheating at that surface to the heated state providing the mentioned sufficient temperature and for recirculation of the heating fluid 28 at its heated state to the subterranean formation 12. Heat from the recirculating heating fluid is applied in the hole 20 to the substance 17 for heating that substance to the mentioned sufficient temperature. The heating fluid 28 is preserved against combustion and chemical reaction during heating, circulation, reheating and recirculation thereof and during application of heat to that substance, and is also preserved against escape into the subterranean formation 12.

The heated substance 17 is driven into the formation 12, such as in the form of a heated fluid 66, for releasing deposits 15 therewith. The released deposits 15 are removed from the subterranean formation, such as in the manner shown at the producer 61.

The circulating heating fluid 28 may comprise heated salt, oil, water or any other substance mentioned above for that purpose, and the comments made above as to their prevention of combustion or escape of heating fluid 28 into the subterranean formation also apply to the system shown in FIG. 2.

Various substances 17 are suitable for use in the system of FIG. 2, including the substances 26 mentioned above in connection with FIG. 1.

The substance 17 may either be dumped into the borehole 20 or a substance already present there may be used for that purpose. For instance, the extension 56 of the closed loop 32 may be immersed into ground water 17 accumulated at the bottom of the hole 20. In that case, the ground water 17 may be heated by the circulating fluid 28 and may be driven into the subterranean formation as hot water 66. Again, a packing 51 in the well casing 23 may be employed for aiding an injection of the hot water or fluid by vapor pressure in the lower part of the bore hole. The water or other substance 17 may even be converted to steam or vapor by transfer of heat from the circulating fluid 28. This in addition to the substance 26 advanced to and vaporized at the subterranean formation 12.

The subterranean deposit may thus be subjected to hot water or hot fluid flooding for thermal stimulation and enhanced recovery of the deposit 15.

In both FIGS. 1 and 2, the substance 26 is stored at the surficial formation 13, such as in a tank 27 on or at the earth surface 14. The substance 26 is so stored in the form of a liquid convertible at the subterranean formation 12 to its vapor phase. The convertible liquid 26 is advanced to the subterranean formation at the hole by a pump 46 and piping 47 for vaporization at 54 with the aid of a heat exchanger or vaporizer 48, essentially as in FIG. 1. However, as already mentioned above originally with respect to FIG. 1, the evaporation process is periodically switched or the direction of flow of the heating fluid 28 is periodically reversed. According to FIG. 2, this periodic switching or reversal may be effected alternatively or may be combined with each other in accordance with the best mode currently contemplated for carrying the invention into practice.

According to FIG. 2, liquid 26 is advanced by the pump 46 from the storage tank 27 through a valve 71 and conduit 47 down the vertical hole 20 to the subterranean formation at the hole 20, for vaporization at 54 with the aid of a downhole heat exchanger 48. In this manner, liquid 26 is converted into a vapor 49 which is driven into the subterranean formation, preferably in the form of a super-heated vapor 16, as already disclosed above in connection with FIG. 1.

As also disclosed above originally in connection with FIG. 1, the heating of the vapor 49 in the subterranean formation 12 with the heating fluid 28 in its extended circulation 56, according to a preferred embodiment of the subject invention, is effected before heat is withdrawn from that heating fluid by the vaporization at 54.

To this effect, the pump 39 circulates the heated fluid 28 from the heater 29 first through a valve 73, closed circuit 32 with extended circulation 56, location of downhole heat exchanger 48, further valve 74, and pump 39 back to and through the heater coils 34 for continuous reheating. In this manner, heat energy for the preferred superheating of the vapor 49 is preserved by vaporizing the liquid 26 only at a portion of the closed circuit 32 extending back to the surface 14 from the extended circulation 56. According to FIG. 2, vaporization at 54 thus only takes place so to speak in the return path of the extended circulation 56. As will become clear in the further course of this disclosure, this remains true, even if the flow of the heating fluid 28 is reversed according to the illustrated preferred embodiment of the subject invention.

As was already mentioned in connection with FIG. 1, scale forming on the pipe 34 may be sloughed off from time to time by alternating contraction and expansion of the pipe, such as by periodically switching the evaporation process or reversing the direction of flow of the heating fluid 28.

In FIG. 2, the heating fluid flow direction may be reversed from time to time by closing valves 73 and 74 and opening corresponding valves 76 and 77. In that case, the pump 39 circulates the heated fluid from the heater 29 through a closed circuit including, in that order, the now open valve 76, piping 34 of closed circuit 32, with extended circulation 56, now open valve 77, pump 39, and heater coils 34. Downhole vaporization of the liquid 26 may either be continued or may be interrupted during such heating fluid flow reversal.

However, if such reversal is for a longer period of time, then the vaporization preferably is switched at 54 as well. In practice, this may be done by having a dual type of heat exchanger, which will work on the piping 34 either to the left, as shown in FIGS. 1 and 2, or to the right as shown alternatively in FIG. 2. In this respect, however, FIG. 2 shows a second liquid supply pipe 147 and a second downhole heat exchanger and vaporizer 148 which correspond to the liquid supply pipe 47 and downhole heat exchanger and vaporizer 48, respectively. By opening a valve 171, a pump 146 is enabled to advance the liquid 26 through the pipe 147 to the downhole heat exchanger 148 for vaporization in the region 54. If the flow of the heating fluid 28 has been reversed at the same time by closing valves 73 and 74 and opening valves 76 and 77, then the heat energy for generation of the superheated vapor 16 is again preserved by vaporizing the pumped liquid 26 only at a portion of the closed circuit 32 extending back to the surface 14 from its extended circulation 56.

In other words, by opening the valves 76, 77, and 171, and activating the pump 146, heat for generation of the vapor 49 is only withdrawn from the circulating heating fluid 28 after extended circulation at 56 and generation of the superheated vapor 16.

According to the preferred embodiment illustrated in FIG. 2, circulation of the heating fluid 28 is periodically reversed in the closed circuit 32 between opposite directions, so as to vaporize the liquid 26 only at the one of two predetermined first and second portions which is located after the extended circulation 56 at either of the opposite directions of heating fluid flow. The latter first portion may be seen in FIG. 2 at the portion of the region 54 covered by the heat exchanger 48. Conversely, the latter second portion may be seen in FIG. 2 at the opposite portion of the region 54 covered by the heat exchanger 148.

In this respect, and in general terms, conversion of the liquid 26 into a vapor 49 is effected at a predetermined first portion of the closed circuit 32 and alternatively at a different second portion of that closed circuit in the hole 20. As seen in FIG. 2, this may be effected by switching positions at the closed circuit 32 at which heat from the recirculating heating fluid 28 is applied to the pumped substance 26.

In practice, the closed circuit 32 may be equipped with an expansion tank 79 without, of course, ceasing to be a closed circuit. Also, conventional check valves and regulating devices may be associated with the valves or stopcocks 71, 73, 74, 77, and 171 and with the pumps 39, 46 and 146, as apparent to a person of ordinary skill in this art. Also, conventional steam-producing heat exchangers other than irrigators which sprinkle the hot piping with the pumped liquid 26, may be employed at 48 and 148.

According to the preferred embodiment illustrated in FIG. 2, the packing 51 is movable, as shown by way of example at 151, so that the heat generated by vaporization is input only at the oil formation.

By way of background, a major drawback of prior-art proposals in this area is that they would require very pure water to have any chance of operating. Since the cost of pure water in remote areas approaches that of oil, those processes obviously result in an economical impossibility in most cases. Because of its method of operation and combination of apparatus features, the subject invention has the particular advantage of operating well with contaminated water of high mineral content, as typically found in remote areas where oil formations occur. For the purpose of the subject invention, even a condensate of the vapor 49 or superheated steam 16 may be employed.

In particular, liquid 26 condensed from the vapor 49 or superheated steam 16 may be pumped through the pipe 63 along with the released deposits 15 and may be applied by the pump 62 to a separator 81, which may be of a conventional type separating the pump oil from the water or other condensate resulting from penetration of the vapor or steam 49 or 16 through the subterranean formation.

The separator applies the pumped deposits or oil to a line 82 and the pumped water or condensate of the substance 26 to a line 83 which adds that recovered substance to the tank 27. In other words, the recovered substance is added to the stored substance 26 for reconversion to vapor 49 at the subterranean formation 12.

In practice, this has the advantage of permitting water or another substance 26 to be used over and over again in the downhole generation of the fluid substance 66 by vaporization at 48 or 148.

Further reduction of scale and other contaminates may be effected with the aid of an inhibitive solution 85, which may be pumped downhole from a tank 86 by pumps 46 and 146. For instance, when a valve 88 is opened, then the pump 46 will advance the inhibitive solution 85 through the pipe 47 to the downhole heat exchanger or vaporizer 48 for application to the piping 34 thereat. Conversely, if the valve 89 is opened, then the pump 146 may advance inhibitive solution 85 through the pipe 147 to the downhole heat exchanger or vaporizer 148 for application to the closed circuit 32 in the region 54. Valves 71 and 171 typically will be closed during that descaling operation, but it is conceivable that inhibitive solution 85 may be mixed in with the pumped substance 26.

Suitable substances for the inhibitive solution 85 include acetic acid, hydrochloric acid, and sulfuric acid in sufficiently low concentration to avoid damage to the system.

Further substances 26 usable for injection by means of the processes shown in FIGS. 1 and 2 include hydrocarbons, such as naphtha, kerosene, and gasoline, and liquefied petroleum gas products, such as ethane, propane, and butane, which in the past have been used in miscible slug tertiary recovery processes or in enriched gas miscible methods.

The methods and equipment herein disclosed may also be used for the hot water, steam or other heated fluid injection phase of injected hydrocarbon or gas enhanced recovery systems.

The systems according to the subject invention may also be employed for or in conjunction with miscellar solution flooding in which surfactants, such as soaps or soap-like substances, solvents, colloids or electrolytes are injected, or in conjunction with polymer flooding in which sweep efficiency is improved by reducing the mobility ratio with polysaccharides, polyacrylamides and other polymers added to injected water or other fluid.

However, it will be found in most situations that the subject invention in its basically disclosed forms will render the complexities and expense of the latter kinds of tertiary recovery processes unnecessary in the recovery of even heretofore practically inaccessible reservoirs and deposits.

In addition to enhanced oil recovery, the processes of the subject invention may also be employed in conjunction with the mining or recovery of coal and other fossil fuels or in conjunction with the recovery of minerals or other substances naturally or artificially deposited in the ground.

Also, while an earth formation 10 has been shown in FIGS. 1 and 2, it is to be understood that the formation 12 in which the deposits 15 are located could be a submarine formation. In that case, the surficial formation would actually be sea or ocean water having a surface 14. In that situation, at least the heater 29 would be located on a drilling platform or other structure located above the water surface 14 and the closed heating fluid circuit 32 would extend therefrom to the ocean floor and into the submarine or subterranean formation located therebelow, but would have to be insulated.

The subject invention also extends to the superior products obtained by the enhanced recovery methods herein disclosed. By way of example, the superheated steam injection methods according to the subject invention provide oil and other fossil fuel recovery products of a quality not attainable by prior-art methods.

The subject extensive disclosure will render apparent or suggest to those skilled in the art various modifications and variations within the spirit and scope of the subject invention and equivalents thereof.

I claim:

1. A method of removing deposits releasable a substance in a vapor phase from a subterranean tion below a surficial formation, comprising in combination the steps of:

providing a hole through said surficial formation to said subterranean formation;

storing said substance at said surficial formation in the form of a liquid convertible at said subterranean formation to said vapor phase;

providing a heating fluid heatable at a surface of said surficial formation remote from said subterranean formation to a temperature sufficient for a conversion of said liquid to said vapor phase at said subterranean formation by a transfer of heat from said heating fluid to said liquid;

heating said heating fluid at said surface of said surficial formation remote from said subtertanean formation to a heated state providing said sufficient temperature and circulating said heating fluid in said hole in a closed circuit extending for said heating fluid at said heated state to said subterranean formation and then back to said surface for repeated reheating at said surface to said heated state providing said sufficient temperature and for recirculation of said heating fluid at said heated state to said subterranean formation;

advancing said convertible liquid to said subterranean formation at said hole;

applying heat from the recirculating heating fluid in said hole to said liquid;

converting said liquid into a vapor by said application of heat from said recirculating heating fluid in said hole, but preserving said heating fluid against combustion and chemical reaction during said heating, circulation, reheating and recirculation thereof and during said application of heat to, and conversion to said vapor phase of, said liquid, and preserving said heating fluid against escape into said subterranean formation;

driving said vapor into said subterranean formation for releasing said deposits with said vapor; and removing said released deposits from said subterranean formation.

2. A method as claimed in claim 1, including the steps of:

extending circulation of said heated heating fluid into said subterranean formation downwardly of a region of said conversion of said liquid into said vapor; and applying heat from said heating fluid in said extended circulation to said vapor of said liquid, while reheating said recirculating heating fluid sufficiently to effect heating of said vapor in said subterranean formation with said heating fluid in said extended circulation.

3. A method as claimed in claim 1, including the steps of:

extending circulation of said heated heating fluid into said subterranean formation downwardly of a region of said conversion of said liquid into said vapor;

applying heat from said heating fluid in said extended circulation to said vapor of said liquid, while reheating said recirculating heating fluid sufficiently for superheating said vapor; and driving said superheated vapor into said subterranean formation for releasing said deposits with said superheated vapor.

4. A method as claimed in claim 1, including the step of:

recovering said substance from the subterranean formation after condensation of said vapor to said liquid; and adding said recovered substance to said stored substance for recoversion to vapor at said subterranean formation.

5. A method as claimed in claim 1, including the steps of:

employing said substance in the form of oil convertible at the subterranean formation to oil vapor;

applying said heat from the recirculating heating fluid in said hole to said oil to convert said oil into said oil vapor; and driving said oil vapor into said subterranean formation for releasing said deposits with said oil vapor.

6. A method as claimed in claim 5, including the step of:

preserving both said heating fluid and said oil vapor against combustion during said application of heat to said oil.

7. A method as claimed in claim 6, including the step of:

recovering said oil from said subterranean formation after condensation of said oil vapor.

8. A method as claimed in claim 1, including the steps of:

employing said substance in the form of water convertible at said subterranean formation to steam;

applying said heat from the recirculating heating fluid in said hole to said water to convert said water to said steam; and driving said steam into said subterranean formation for releasing said deposits with said steam.

9. A method as claimed in claim 8, including the steps of:

extending circulation of said heated heating fluid into said subterranean formation downwardly of a region of said conversion of said water into steam;

applying heat from said heating fluid in said extended circulation to said steam, while reheating said circulating heating fluid sufficiently to effect conversion of said steam into superheated steam; and driving said superheated steam into said subterranean formation for releasing said deposits therewith.

10. A method as claimed in claim 1, including the steps of:

using as said heating fluid a salt heated to a liquid state for conversion of the first-mentioned liquid to said vapor phase by heat exchange at said subterranean formation;

recirculating said salt in said liquid state in said closed circuit; and reheating said recirculating salt at said surface.

11. A method as claimed in claim 1, including the steps of:

using water as said heating fluid;

circulating and recirculating said water in said closed circuit;

heating and reheating said recirculating water at said surface sufficiently for a conversion of the first-mentioned liquid to said vapor phase by heat exchange at said subterranean formation; and converting said liquid into said vapor by application of heat from said heated recirculating water to said liquid in said hole, but preserving said heated recirculating water against escape into said subterranean formation.

12. A method as claimed in claim 11, including the step of:

preventing boiling of said water during said heating and reheating at said surface and during said circulation, said recirculation and said application of heat to said liquid in said hole.

13. A method as claimed in claim 1, including the steps of:

extending circulation of said heated heating fluid into said subterranean formation downwardly of a region of said conversion of said liquid into vapor;

applying heat from said heating fluid in said extended circulation to said vapor, while reheating said circulating heating fluid sufficiently to effect conversion of said vapor into superheated vapor;

driving said superheated vapor into said subterranean formation for releasing said deposits therewith; and preserving heat energy for said superheating of vapor by vaporizing said liquid only at a portion of said closed circuit extending back to said surface from said extended circulation.

14. A method as claimed in claim 13, including the step of:

periodically reversing circulation of said heating fluid in said closed circuit and switching said portion of said closed circuit at which said vaporizing of said liquid occurs.

15. A method as claimed in claim 1, including the step of:

periodically reversing circulation of said heating fluid in said closed circuit.

16. A method as claimed in claim 1, including the step of:

effecting conversion of said liquid into a vapor at a predetermined first portion of said closed circuit and alternatively at a different second portion of said closed circuit in said hole.

17. A method as claimed in claim 16, including the steps of:

extending circulation of said heated heating fluid into said subterranean formation downwardly of said predetermined first portion and said second portion of said closed circuit;

applying heat from said heating fluid in said extended circulation to said vapor, while reheating said circulating heating fluid sufficiently to effect conversion of said vapor into superheated vapor;

driving said superheated vapor into said subterranean formation for releasing said deposits therewith; and periodically reversing circulation of said heating fluid in said closed circuit between opposite directions so as to vaporize said liquid only at that of said predetermined first and second portions which is located after said extended circulation at either of said opposite directions.

18. A method of removing deposits releasable by a heated fluid substance from a subterranean formation below a surficial formation, comprising in combination the steps of:

providing a hole through said surficial formation to said subterranean formation, providing a heating fluid heatable at a surface of said surficial formation remote from said subterranean formation to a heated state providing a temperature sufficient for heating said substance, by a transfer of heat from said heating fluid to said substance, to said fluid substance for a release of said deposits in the subterranean formation;

heating said heating fluid at said surface of said surficial formation remote from said subterranean formation to said heated state providing said sufficient temperature and circulating said heating fluid in said hole in a closed circuit extending for said heating fluid at said heated state to said subterranean formation and then back to said surface for repeated reheating at said surface to said heated state providing said sufficient temperature and for recirculation of said heating fluid at said heated state to said subterranean formation;

advancing said substance from said surficial formation to said subterranean formation at said hole;

applying heat from the recirculating heating fluid in said hole to said substance for heating said substance to said sufficient temperature but preserving said heating fluid against combustion and chemical reaction during said heating, circulation, reheating and recirculation thereof and during said application of heat to said substance, and preserving said heating fluid against escape into said subterranean formation;

driving said heated substance into said subterranean formation for releasing said deposits with said heated substance; and removing said released deposits from said subterranean formation.

19. A method as claimed in claim 18, including the steps of:

using as said heating fluid a salt heated to a liquid state for circulation in said heated state in said closed circuit;

recirculating said salt in said liquid state in said closed circuit; and reheating said recirculating salt at said surface to said heated state.

20. A method as claimed in claim 18, including the steps of:

using water as said heating fluid;

circulating and recirculating said water in said closed circuit;

heating and reheating said recirculating water at said surface to said heated state; and preserving said heated recirculating water against escape into said subterranean formation.

21. A method as claimed in claim 18, including the step of:

periodically reversing circulation of said heating fluid in said closed circuit.

22. A method as claimed in claim 18, including the step of:

switching positions at said closed circuit at which heat from the recirculating heating fluid is applied to said substance.

23. In apparatus for enhanced recovery of deposits releasable by a substance in a vapor phase from a subterranean formation below a surficial formation via a hole through said surficial formation to said subterranean formation, the improvement comprising in combination:

means at said surficial formation for storing said substance in the form of a liquid convertible at said subterranean formation to said vapor phase;

means for heating a heating fluid at a surface of said surficial formation remote from said subterranean formation to a heated state providing a temperature sufficient for a conversion of said liquid to said vapor phase at said subterranean formation by a transfer of heat from said heating fluid to said liquid;

means connected to said heating means for circulating said heating fluid in said hole in a closed circuit extending for said heating fluid at said heated state to said subterranean formation and then back to said surface for repeated reheating at said surface by said heating means to said heated state providing said sufficient temperature and for recirculation of said heating fluid at said heated state to said subterranean formation;

means connected to said storing means for advancing said convertible liquid to said subterranean formation at said hole;

means for applying heat from the recirculating heating fluid in said hole to said liquid and for converting said liquid into a vapor by said application of heat from said recirculating heating fluid in said hole;

means for driving said vapor into said subterranean formation for releasing said deposits with said vapor for a removal of said released deposits from said subterranean formation; and said heating means, circulating means and said means for applying heat from the recirculating heating fluid to said liquid including means for preserving said heating fluid against combustion and chemical reaction during said heating, circulation, reheating and recirculation thereof and during said application of heat to, and conversion to said vapor phase of, said liquid, and for preserving said heating fluid against escape into said subterranean formation.

24. Apparatus as claimed in claim 23, wherein:

said circulating means include means for extending circulation of said heated heating fluid in said closed circuit into said subterranean formation downwardly of a region of said conversion of said liquid into said vapor for heating said vapor after said conversion.

25. Apparatus as claimed in claim 23, including:

means for superheating said vapor, including means for extending circulation of said heated heating fluid in said closed circuit into said subterranean formation downwardly of a region of said liquid into said vapor for heating said vapor after said conversion; and means in said heating means for reheating said recirculating heating fluid sufficiently for superheating said vapor.

26. Apparatus as claimed in claim 25, wherein:

said means for applying heat from the recirculating heating fluid in said hole to said liquid include means for vaporizing said liquid only at a portion of said closed circuit extending back to said surface from said extended circulation.

27. Apparatus as claimed in claim 26, including:

means for periodically reversing circulation of said heating fluid in said closed circuit; and means for switching said portion of said closed circuit at which said vaporizing of said liquid occurs.

28. Apparatus as claimed in claim 23, including:

means connected to said closed circuit for periodically reversing circulation of said heating fluid in said closed circuit.

29. Apparatus as claimed in claim 23, including:

means for effecting conversion of said liquid into a vapor at a predetermined first portion of said closed circuit and alternatively at a different second portion of said closed circuit in said hole.

30. Apparatus as claimed in claim 23, wherein:

said means for driving said vapor into said subterranean formation include a packing movable in said hole.

31. Apparatus as claimed in claim 23, including:

means for recovering said substance from the subterranean formation after condensation of said vapor to said liquid; and means connected to said storing means for adding said recovered substance to said stored substance for reconversion to vapor at said subterranean formation.

32. Apparatus as claimed in claim 23, wherein:

said circulating means include conduit means connected in a closed circuit through said heating means and said hole to said subterranean formation for circulating, reheating and recirculating said heating fluid.

33. In apparatus for enhanced recovery of deposits releasable by a heated fluid substance from a subterranean formation below a surficial formation via a hole through said surficial formation to said subterranean formation, the improvement comprising in combination:

means for heating a heating fluid at a surface of said surficial formation remote from said subterranean formation to a heated state providing a temperature sufficient for heating said substance by a transfer of heat from said heating fluid to said substance, to said fluid substance for a release of said deposits in said subterranean formation;

means connected to said heating means for circulating said heating fluid in said hole in a closed circuit extending for said heating fluid at said heated state to said subterranean formation and then back to said surface for repeated reheating at said surface by said heating means to said heated state providing said sufficient temperature and for recirculation of said heating fluid at said heated state to said subterranean formation;

means for advancing said substance from said surficial formation to said subterranean formation at said hole;

means for applying heat from the recirculating heating fluid in said hole to said substance for heating said substance to said sufficient temperature;

means for driving said substance as a heated fluid substance into said subterranean formation for releasing said deposits with said heated fluid substance for a removal of said released deposits from said subterranean formation; and said heating means, circulating means and said means for applying heat from the recirculating heating fluid to said substance including means for preserving said heating fluid against combustion and chemical reaction during said heating, circulation, reheating and recirculation thereof and during said application of heat to said substance, and for preserving said heating fluid against escape into said subterranean formation.

34. Apparatus as claimed in claim 33, including:

means for periodically reversing circulation of said heating fluid in said closed circuit.

35. Apparatus as claimed in claim 33, including:

means for switching positions at said closed circuits at which heat from the recirculating heating fluid is applied to said substance.

* * * * *